United States Patent [19]

Rabold

[11] Patent Number: 4,971,327

[45] Date of Patent: Nov. 20, 1990

[54] GOLDHEAD LIGHTING DEVICE AND METHOD FOR TEACHING AND PRACTICE PUTTING

[76] Inventor: Bill Rabold, P.O. Box 854, Bellaire, Mich. 49615

[21] Appl. No.: 453,801

[22] Filed: Dec. 20, 1989

[51] Int. Cl.[5] ..... A63B 69/36

[52] U.S. Cl. ..... 273/186 A; 273/194 A; 273/192; 434/252

[58] Field of Search ..... 273/186 AA, 186 A, 186 R, 273/186 C, 186 D, 167 A, 192, 194 A; 434/252

[56] References Cited

U.S. PATENT DOCUMENTS 2,787,470 4/1957 Barrus et al. ..... 273/186 AA

*Primary Examiner*—Benjamin Layno

*Attorney, Agent, or Firm*—T. M. Gernstein

[57] ABSTRACT

A device used to teach and practice a connected putting stroke includes a putter-like device having a clubhead on one end and a grip on the other end. A light assembly in the clubhead includes three lights that are mounted to focus light beams directly out of the bottom edge of the clubhead at a 90° angle to that clubhead bottom edge so that the light beams are located directly beneath the clubhead. A swing track includes paths and path portions suitable for learning and practicing square-to-square, inside-to-outside and outside-to-inside putting strokes in a connected manner. Locating the clubhead light assembly directly beneath the clubhead bottom edge keeps the golfer's eyes focused directly on the clubhead and thus tends to keep the golfer's hands, arms and body operating as a connected synchronized unit.

22 Claims, 2 Drawing Sheets

GOLDHEAD LIGHTING DEVICE AND METHOD FOR TEACHING AND PRACTICE PUTTING

TECHNICAL FIELD OF THE INVENTION

The present invention relates to the general art of sport training device, and to the particular field of golf teaching and practicing aids.

BACKGROUND OF THE INVENTION

The popularity of golf is well documented in the United States, and its popularity in other countries, such as Japan, is growing rapidly. Golfer's skills vary from high-scoring duffers to tournament-winning professionals, yet no golfer ever gets so consistently good that he can't benefit from some constructive training or practice.

It has been stated that the major difference in today's golfers is found in the putting portion of the game of golf. In fact, many modern golf courses have been designed to make putting an even more important phase of the game.

The putting stroke generally includes several phases: the address or set-up phase which the golfer initially assumes in relation to the ball with the clubhead located behind the ball before hitting a shot; the backswing phase in which the club is drawn back into a cocked position; the striking phase in which the putter is moved to and through the ball; and the follow-through phase of the stroke in which the putter is moved past and beyond the hitting zone to finish the stroke.

There are many styles and methods of putting; however, regardless of the extreme or conservative nature of the various styles, the effective styles all have several basic factors in common. The basic traits that the effective putting strokes have in common are: a connected swing; square clubface at the moment of impact; and properly aligned eyes. In addition to these basic traits, an effective putter has proper tempo, confidence and versatility. All such traits should be learned and practiced if the golfer is to be an effective putter.

Thus, it is extremely important to keep the arms, hands and upper body in synch and moving as a unit during the entire putting stroke from set-up to finish. This unitary movement of the hands, arms and upper body is referred to as "connection" by textbooks, such as "How to Perfect your Golf Swing", by J. Ballard, published Golf/Tennis Inc., 1981. In particular, at pages 23, 29, 42, 57–58, 60, 77–87 and 119–141 (the disclosure of which is incorporated herein by reference), this text discusses the importance of maintaining such connection throughout an entire swing. If the unit is disconnected, accuracy, and consistency will be vitiated, if not entirely lost.

The present inventor has found that such connection is just as important in a putting stroke as it is in the other swings associated with golf. The connected swing will ensure that the clubhead is carried back low and on line and follows through low and on line.

A second basic trait that all effective putting strokes have in common is that the clubface is maintained square to the line of ball movement at impact. If the clubface is not square to the intended line of the putt at impact, the ball will move off line and the accuracy of the putt will be lost.

A third basic trait that all effective putting strokes have is that the golfer has his eyes aligned vertically over the ball or vertically over the target line behind the ball. If the golfer's eyes are not so aligned, optical impressions may mislead him into incorrectly aiming the clubface and thereby misdirecting the ball.

In a putting stroke, as in any other sports stroke, it is critical that the golfer receive and retain an accurate picture in his mind of the basic moves involved in the swing. Any practice move which is repeated by a golfer is going to register in his mind as a form of "muscle memory". Therefore, the golfer, in order to program the correct set-up, backswing, striking phase and follow-through, must be able to visually appreciate those moves so that his muscle memory is accurate and repeatable.

Likewise, any error in the practice movement will be repeated in the actual putting stroke. In other words, "practice makes permanent".

Therefore, it is extremely important for any practice device or technique to be designed to promote proper habits, including maintaining connection and ensuring that the club face will be square to the desired path at the moment of impact between the clubface and the ball.

Since putting is such an extremely important phase of the overall game, there have been many and varied golf putting practice devices proposed in the art.

While all practice and/or teaching devices, in theory, propound correctness, not all such devices actually, in practical application, provide such correctness.

For example, the above-discussed connection is not always produced. In fact, some devices that use a path over which a club is moved actually promote disconnection.

For example, if the club is moved along a path and the golfer is forced to focus on the path in front of or to the side of or in back of the clubhead, disconnection is actually encouraged because the target is disconnected from the clubhead. Thus, the golfer is caused to visually begin the swing and to hit the ball looking at a target that is not in the proper position. This off-line guide causes the golfer to have a tendency to move the clubface toward a spot that is not in line with the club at any particular instant. This actually tends to force the golfer's hands and arms away from his body. This disconnection begins at set-up and continues throughout the entire swing.

The device that include a target that is disconnected from the club itself also can cause the club to be moved in a manner that has the face thereof out of square at impact thereby violating another of the basic requirements for an effective putting stroke.

Therefore, it is seen that the presently available teaching and training aids used to teach and practice putting have shortcomings with regard to teaching and practicing the basic elements of an effective stroke.

A still further problem with many of the presently available teaching devices is the physical contact between the device and the golfer during the practice and/or training. Thus, devices such as disclosed in U.S. Pat. No. 3,899,180 that provide a guide for the putter cause correction by having the putter contact the guide during practice if that putter is moved off line.

It has been found that teaching a motor skill is most efficient if there is no physical contact during the practice movements so that the student must rely on his visual and his intrinsic sensory perception skills rather than his tactile senses to sense that portion of his body making an error, and then to correct the movement of that portion of his body making that error. The student is forced to visualize his body movements and orientation and then correct any errors using his own perceptual system if physical contact is avoided; whereas, if there is physical contact, the student is made aware of the precise body part that is in error, and is given a clue to how much it is in error by his tactile senses. This is not how things are in the real world, and thus the training is not as efficient as it could be.

In addition to being proficient with the abovementioned basic traits, those golfers who excel at the putting phase of the game may be able to change their stroke to fit the exact existing conditions or to be most comfortable. That is, to be extremely versatile, the golfer should have the ability to vary his putting stroke from a so-called "square-to-square" stroke to a so-called "open-to-closed" stroke to a so-called "closed-to-open" stroke while still retaining accuracy, tempo, concentration and confidence in his putting skills. This ability can only be developed by practicing all of the putting skills, and presently available teaching and training devices do not provide the facilities to permit a golfer to efficiently practice all of the different putting strokes.

In the square-to-square stroke, the clubface is swung away from and back through the ball without that clubface ever turning. In the open-to-closed stroke, the clubface is rotated slightly clockwise on the backswing and commensurately counterclockwise through; the ball. In the closed-to-open stroke, the club face is rotated slightly counterclockwise on the backswing and commensurately clockWise through the ball.

All of the practice and teaching devices known to the inventor are set up for one swing type, usually the square-to-square sWing, and thus prohibits the golfer from practicing any other type of swing. This limitation not only limits a golfer's swing selection, it maY force him to practice a swing that is not comfortable to him. That is, the golfer maY be more comfortable with an inside-to-outside swing than a square-to-square swing. In such a case, this golfer will not be able to use the training and teaching device to his best advantage.

Still further, presently available putting devices generallY provide an indication of the stroke only at the time of impact between the club and the ball. For example, devices such as the devices disclosed in U.S. Pat. Nos. 4,342,455, 4,306,722, 4,306,723 and 4,342,456, all provide an indication of swing correctness only at one or two points during the swing. This forces the student to wait for the corrections in his swing. It has been found that the most efficient teaching of motor skills is made when there is an immediate and a continuous feedback as to correctness of the bodY motions associated with the skill. Accordingly, the presently known devices used to teach and practice putting are not as efficient as they could be.

Accordingly, there is need for a putting teaching and training aid that will permit a golfer to efficiently learn and practice a putting stroke that is connected, keeps the clubface square to the ball at impact, permits the golfer to practice a variety of different swings and does not use tactile senses to teach the skills while providing a continuous and an immediate feedback as to the correctness of the golfer's body motions associated with the putting stroke being practiced or learned.

OBJECTS OF THE INVENTION

It is a main object of the present invention to provide a means and method of teaching putting that is, in practical application, proper.

It is another object of the present invention to provide a means and a method for teaching a putting stroke that is connected.

It is another object of the present invention to provide a means and method for teaching a putting stroke that is connected and which has the clubface square to the desired putting line at impact.

It is another object of the present invention to provide a means and a method of teaching a putting stroke which is amenable to practicing a wide varietY of different putting strokes, with each stroke being properlY practiced with regard to the basic elements of an effective putting stroke.

It is another object of the present invention to provide a means and a method of teaching a putting stroke which is amenable to practicing an open-to-closed putting stroke.

It is another object of the present invention to provide a means and a method of teaching a putting stroke which is amenable to practicing a closed-to-open putting stroke.

It is another object of the present invention to provide a means and a method for teaching a putting stroke which is amenable to practicing a closed-to-open putting stroke.

It is another object of the present invention to provide a means and a method for teaching a putting stroke a in which there is constant and continuous reinforcement and correction of the putting stroke throughout the entire stroke.

SUMMARY OF THE INVENTION

These, and other, objects are achieved by providing a golf putting stroke practice means and method which includes a putter-like club that includes a shaft having a clubhead on one end thereof, and placing a light assembly in that clubhead to direct light beams out of the bottom edge of that clubhead at 90' to that lower edge against a swingtrack that includes a plurality of paths.

The lights from the clubhead shine directly beneath the clubhead so that the golfer is forced to keep his eyes directly on the clubhead and not focused on some target that is spaced from the clubhead. As discussed above and in patent Ser. No. 4,911,450, the disclosure of which is fully incorporated herein by reference, such action keeps the golfer's swing connected throughout the entire swing. This also provides constant and continuous correction and reinforcement to the golfer as he practices or learns the swing as he can see the swing track at all times as his club traces that track. This means and method also keeps the golfer's eyes located in proper alignment with the club as the light that is being matched to the swing track is directly beneath the clubhead, and the clubhead can be kept square to the ball at impact as the golfer is focusing on the clubhead and the location directlY beneath such clubhead rather than on some target that is disconnected from the clubhead.

Since there is no phYsical contact, the golfer is forced to learn the motor skill of putting using his visual and intrinsic self-awareness senses without use of his tactile senses, which is more efficient than such a teaching method which relies on tactile senses.

The swing track also includes a plurality of paths so that various putting strokes can be learned and practiced.

DETAILED DESCRIPTION OF THE PREFERRED EMBODIMENT OF THE INVENTION

Figure 1:
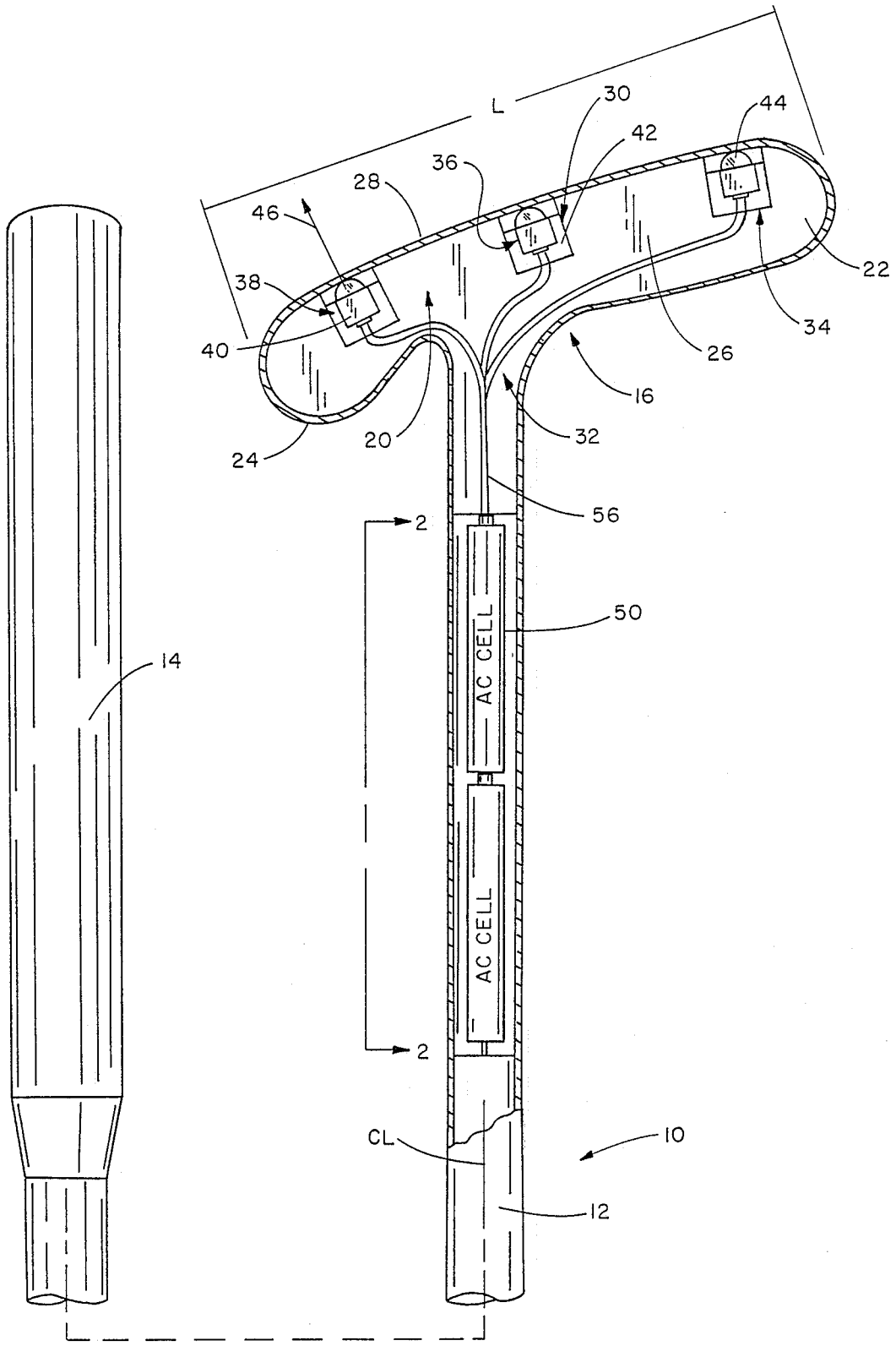
FIG. 1 is a side elevational view of the golf putter-like practice device embodying the present invention.

Shown in FIG. 1 is a golf putter-like device 10 embodying the present invention. The device 10 has the general appearance of a putter; however, it need not be made of the same materials as a conventional putter, since it is a practice and learning device. The device preferablY is made of plastics-type material, and can be made in several different shapes, sizes and weights to suit the golfer since putters are often manufactured in many different sizes, shapes and weights. Preferably, the device is less than the length of a standard putter, and preferably is less than 28″ to 35″ long. The device 10 includes a shaft 12 having a longitudinal axis CL and has a grip 14 on one end of the shaft and a clubhead 16 on the other end of the shaft.

The clubhead 16 includes a body 20 that includes a toe 22, a heel 24, a central portion 26 and a lower edge 28 that extends for the entire length L of the bodY from the toe to the heel. The shaft 14 is connected to the body between the toe and the heel, and the bodY includes a sweet spot 30 located between the shaft and the toe. It is noted that the sweet spot can be located at other positions, and the location shown in FIG. 1 is only an example and is not intended as a limitation.

The device 10 further includes a light assembly 32 mounted in the clubhead 20. The light assembly 32 includes three lights: a toe light 34 located adjacent to the toe 22; a sweet spot light 36 located adjacent to or at the sweet spot 30 and a heel light 38 located adjacent to the heel 24. The lights are spaced apart along the length L of the body 20.

Figure 3:
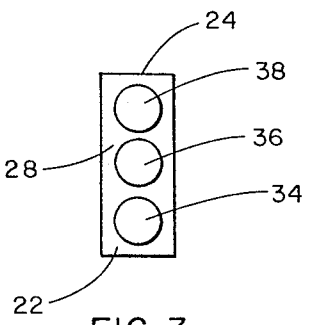
FIG. 3 is a bottom end view of the club head of the device embodying the present invention showing the lights located in the bottom edge of the clubhead each of which shines a light beam out of that bottom edge at a 90′ angle with respect to the lower edge adjacent to such light.

As shown in FIGS. 1 and 3, each light includes a mounting, such as mounting 40, affixed to the body 20 in a recessed cavity, such as cavity 42, and a light bulb, such as bulb 44 in mounting 40. Reflectors or other such devices, including lenses and the like, are also included to ensure that the light beam, such as beam 46, is collimated and is focused sharply enough to be clearly seen by a golfer who has adopted his usual putting stance holding the device bY the grip. The bulbs are removable mounted in the mountings by threaded means or the like.

The lights are mounted to focus the beams of light 46 directly out of the body at a 90′ angle to the lower edge 28 adjacent to the light to be aimed at a location that is directly beneath such lower edge.

Figure 2:
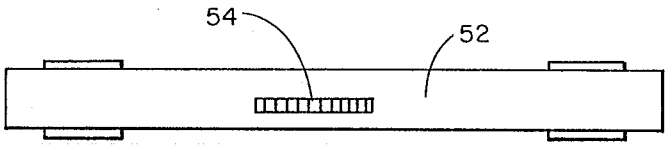
FIG. 2 is a view of the switch used to control the light assembly of the golf putter-like device of the present invention as seen from view 2—2 in FIG. 1.

As above discussed, and as discussed in the referenced patent, locating the lights to aim the beams of light directly out of the lower edge of the clubhead at a 90′ angle to that portion of the lower edge that is immediately adjacent to the light causes the golfer to maintain his swing connected from start to finish by keeping his eyes focused on a target that is located directly beneath the lower edge of the clubhead as opposed to a target that is spaced from such location, either toward the shaft or in front of the clubhead. The device 10 further includes a light assembly actuating system that includes batteries, such as battery 50, removable mounted in the clubhead or in the shaft in a battery compartment that is covered by a cover 52 that is removable mounted on the shaft, an on/off switch 54 on the shaft (see FIG. 2) or on the clubhead, and leads, such as lead 56, electrically connecting the batteries to the lights of the light assembly via the switch 54. Actuation of the switch actuates all of the lights of the light assembly, or an alternative embodiment can include a multi-position switch that can be operated to actuate only selected ones of the lights if so desired. Actuation of the light assemblY produces the light beams 46, and the batteries are located to provide proper balance to the device. Further weights can also be included as suitable. The device 10 is held and swung exactly like a putter during a putting stroke from a set-up address position, through the backswing, the striking swing and the follow through. At all times during such swing, the light beams 46 are aimed directly orlt of the bottom or lower edge of the clubhead so the golfer's eyes are focused on the clubhead at all times thereby keeping the swing connected from start to finish.

Figure 4:
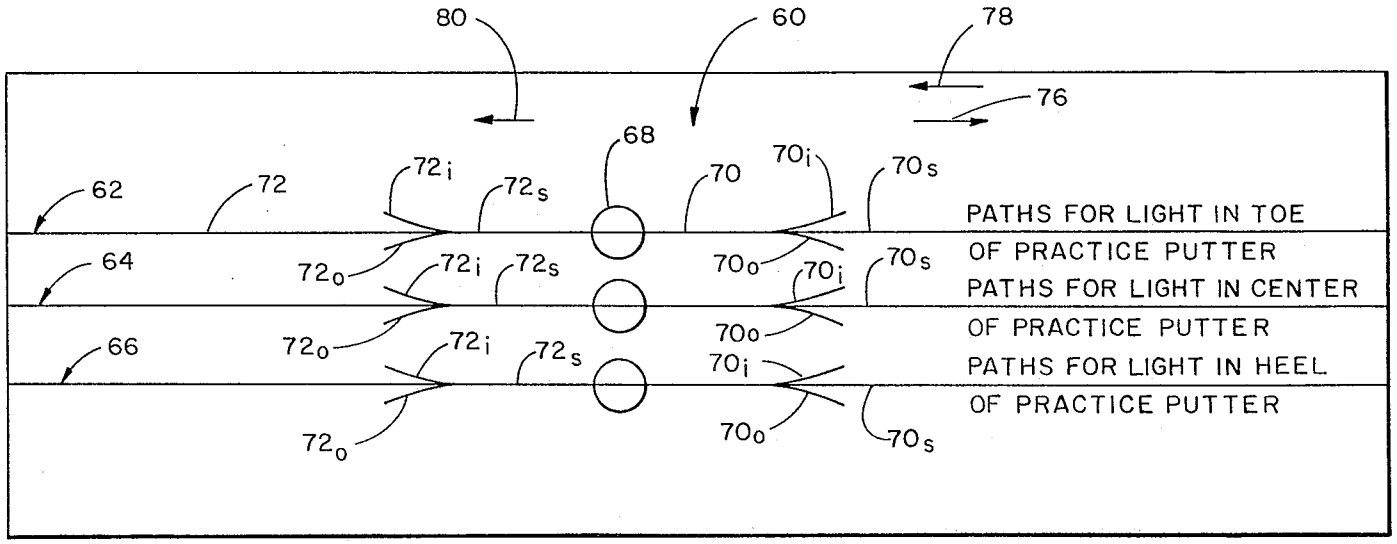
FIG. 4 is a schematic of a swing track used in the method of teaching and practicing a golf putting stroke of the present invention.

A swing track 60 is shown in FIG. 4, and is used in teaching and practicing a variety of golf putting strokes. As shown in FIG. 4, swing track 60 includes three paths 62, 64 and 66 that are spaced apart and located to correspond to the spacing and location of the beams of light from the lights 34, 36 and 38 respectivelY. The light beams from these lights trace the swing track paths during the putting stroke.

Each of the swing track paths also includes an indicator 68 for the ball location at set up, a backswing portion 70 which corresponds to the backswing portion of the stroke and a follow-through portion 72 which corresponds to the follow-through portion of the stroke.

In use, the light assembly of the device 10 is actuated to activate the light beams 46, the device is positioned adjacent to the indicator 68 with the light beams 46 from lights 34, 36 and 38 focused on the backswing portions 70 of paths 62, 64 and 66 respectively. The device is then moved in a backswing motion in the backswing direction 76 while keeping the light beams on the path portions of the swing track.

The device is then moved in the striking phase of the stroke in direction 78 in a striking motion while keeping the light beams on the track portions as the device is moved toward and through the ball indicator 68, with the direction 78 being opposite to the direction 76 but along the same path portions. Once the device clubhead is moved beyond the indicator 68 in direction 78, the device is being moved in a follow-through phase of the putting stroke, and this follow-through phase is indicated in FIG. 4 by arrow 80.

Since the beams of light are all aimed directly out of the bottom of the clubhead, the golfer is forced to focus his eyes on the clubhead at all times during the swing, thereby keeping his swing connected during all phases of the swing, from set-up to follow-through finish while receiving continuous correction from the superpositioning of the light beams onto the continuous swing track traces.

As is also shown in FIG. 4, the swing track 60 also includes guide paths for an inside-to-outside swing and for an outside-to-inside swing as well as for a square-to-square swing. The square-to-square stroke is achieved using paths $70_8$ and $72_8$ of the paths 62–66; the inside-to-outside swing is achieved using paths $70_1$, and $72_1$ of the paths 62–66; and the outside-to-inside swing is achieved using paths $70_0$ and $72_0$ of the paths 62–66. As can be seen, even using the additional path portions, because the light beams are directed out of the bottom edge of the club head at a 90° angle, the golfer's swing will remain connected throughout the entire swing.

The additional paths are used in a manner that is similar to that just described beginning at set-up with the clubhead directly behind the ball indicator 68 on the backswing portion of the paths. The clubhead is then moved in the backswing direction 76 along the path appropriate to the selected swing type, and then is moved in the striking motion in direction 78 along that same path to and through the ball indicator 68. After moving smoothly through the ball indicator 68, the clubhead is moved in the follow-through direction 80 along the path that is appropriate to the selected swing type.

For example, a square-to-square swing will move the club head from a location immediately behind the indicator 68 in direction 76 so that light beam 46 from the heel light 38 traces path portion $70_8$ of path 62 in direction 76. The striking portion of the stroke is then executed by moving the clubhead in direction 78 while keeping the light beam 46 from heel light 38 tracing the same path portion 70 to and through the ball indicator 68. The follow-through phase of the swing is then executed by moving the clubhead so that the light beam 46 of the heel light follows the path portion 72. The other light beams from the other lights will follow the appropriate paths and path portions, and the other swing types will be executed in a similar manner using the appropriate paths and path portions. These other combinations will not be described as those skilled in the art will be able to understand what is achieved from the description presented herein. It is also noted that the relative sizes and shapes of the various swing path portions can be varied according to the needs of each golfer without departing from the scope of the present disclosure, and the path shapes and sizes shown are merelY for the purpose of description and not for the purpose of limitation.

It is understood that while certain forms of the present invention have been illustrated and described herein, it is not to be limited to the specific forms or arrangements of parts described and shown.

I claim:

1. A device for teaching and practicing a proper golf putting stroke comprising:

(A) a short shaft having a longitudinal axis;

(B) a clubhead on one end of said shaft, said clubhead having a bottom edge;

(C) a clubhead light assembly in said clubhead, said light assembly including three lights mounted on said clubhead bottom edge and oriented on said clubhead to direct beams of light at 90′ to said clubhead bottom edge and being mounted to direct said beams of light directly out of said clubhead bottom edge to be located directly beneath said clubhead, whereby said clubhead lights move in the exact path of said clubhead directly beneath said clubhead as the device is swung in a golf putting stroke motion so that said clubhead lights form targets directly beneath said clubhead for a golfer's eyes to be focused on during the execution of the golf putting stroke.

2. The device defined in claim 1 further including a sweet spot on said clubhead, with one of said clubhead lights being mounted to direct a beam of light directly beneath said sweet spot.

3. The device defined in claim 2 wherein said clubhead includes a toe and a heel which are positioned to have said shaft located between them.

4. A method of teaching and practicing a proper golf putting stroke comprising:

(A) providing a device as defined in claim 1;

(B) providing a swing track which includes a backswing path and a ball location indicating means;

(C) addressing said ball location indication means during a setup up phase of a putting stroke;

(D) executing a backswing phase of a golf putting stroke;

(E) tracing the backswing path in a first direction with light from the clubhead light assembly during the backswing phase of the putting stroke;

(F) executing a striking phase of the golf putting stroke;

(G) tracing the backswing path with light from the light assembly in a second direction that is opposite to the first direction during the striking phase of the putting stroke; and (H) maintaining a golfer's hands, arms and body connected and operating as a synchronized unit during the set-up, backswing and striking phase of the putting stroke.

5. The device defined in claim 3 wherein said device is formed of plastics-like material.

6. The device defined in claim 3 wherein said light assembly further includes a toe light located adjacent to said clubhead toe.

7. The device defined in claim 6 wherein said light assembly further includes a heel light located adjacent to said clubhead heel.

8. The device defined in claim 1 wherein said shaft is less than 28″ long.

9. The device defined in claim 8 further including an actuating means for actuating said light assembly.

10. The device defined in claim 9 wherein said actuating means includes a battery in said clubhead, a switch on said shaft and leads connecting said batterY to the lights of said light assembly via said switch.

11. The device defined in claim 9 wherein said actuating means includes a batterY in said shaft, a switch on said shaft and leads connecting said batterY to the lights of said light assemblY via said switch.

12. The device defined in claim 11 wherein said battery is located adjacent to said clubhead.

13. The device defined in claim 1 wherein said shaft is less than 35″ long.

14. The method defined in claim 13 further including providing a follow-through path in the swing track.

15. The method defined in claim 14 further including executing a follow-through phase of the putting stroke.

16. The method defined in claim 15 further including maintaining the golfer's hands, arms and bodY connected and operating as a synchronized unit during said follow-through phase of the golf putting stroke.

17. The method defined in claim 16 further including providing a second backswing path on the swing track.

18. The method defined in claim 17 including tracing the second backswing path with light from the clubhead light assembly during said backswing phase of the putting stroke.

19. The method defined in claim 18 further including providing a second follow-through path on the swing track and tracing the second follow-through path with light from the light assembly during a follow-through phase of the putting stroke.

20. The method defined in claim 19 wherein the swing track includes three paths that are each located to lie directly beneath one of the light assembly lights.

21. The method defined in claim 19 further including a third path on each path, and tracing said paths in an inside-to-outside putting stroke.

22. The method defined in claim 19 further including a third path on each path, and tracing said paths in an outside-to-inside putting stroke.

* * * * *

UNITED STATES PATENT AND TRADEMARK OFFICE

CERTIFICATE OF CORRECTION

PATENT NO. : 4,971,327

DATED : November 20, 1990

INVENTOR(S) : Bill Rabold

It is certified that error appears in the above—identified patent and that said Letters Patent is hereby corrected as shown below:

Amend the Title to read as follows:

-- GOLFHEAD LIGHTING DEVICE AND METHOD FOR TEACHING AND PRACTICING PUTTING--

Signed and Sealed this

Nineteenth Day of May, 1992

*Attest:*

DOUGLAS B. COMER

*Attesting Officer*

*Acting Commissioner of Patents and Trademarks*